US009709000B2

(12) United States Patent
Uemizu

(10) Patent No.: US 9,709,000 B2
(45) Date of Patent: Jul. 18, 2017

(54) CYLINDER HEAD OF ENGINE

(71) Applicant: Suzuki Motor Corporation, Hamamatsu-shi, Shizuoka (JP)

(72) Inventor: Takanori Uemizu, Hamamatsu (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 146 days.

(21) Appl. No.: 14/137,357

(22) Filed: Dec. 20, 2013

(65) Prior Publication Data

US 2014/0190450 A1 Jul. 10, 2014

(30) Foreign Application Priority Data

Jan. 10, 2013 (JP) ..... 2013-002550

(51) Int. Cl.
*F02F 1/42* (2006.01)
*F02F 1/24* (2006.01)
(Continued)

(52) U.S. Cl.
CPC *F02F 1/24* (2013.01); *F01L 1/14* (2013.01); *F01L 1/143* (2013.01); *F01L 1/16* (2013.01);
(Continued)

(58) Field of Classification Search
CPC ..... F01L 2107/00; F01L 1/14; F01L 1/143; F01L 1/16; F01L 1/245; F01L 2001/2433
(Continued)

(56) References Cited

U.S. PATENT DOCUMENTS 3,314,303 A * 4/1967 Maat ..... F01L 1/14 123/90.5
4,621,597 A * 11/1986 Kawada ..... F01L 1/04 123/193.5
(Continued)

FOREIGN PATENT DOCUMENTS

CN 101360912 A 2/2009
DE 3806906 C2 3/1990
(Continued)

OTHER PUBLICATIONS

Chinese Office Action mailed Nov. 23, 2015, issued to Chinese Application No. 201310752443.1.
(Continued)

*Primary Examiner* — Sizo Vilakazi
*Assistant Examiner* — Kevin R Steckbauer
(74) *Attorney, Agent, or Firm* — Stein IP, LLC

(57) ABSTRACT

There is provided a cylinder head of an engine. The cylinder head includes cylindrical parts for lash adjustors into which the lash adjustors are inserted and cylindrical parts for fuel injection valves into which the fuel injection valves are inserted. An outer periphery of each of the cylindrical parts for the lash adjustors is connected to a sidewall of the cylinder head, which is disposed above intake ports communicating with a combustion chamber and each of the cylindrical parts for the fuel injection valves is disposed below the cylindrical parts for the lash adjustors. A lower end portion of each of the cylindrical parts for the lash adjustors is connected to an upper part of each of the cylindrical parts for the fuel injection valves by a reinforcement part.

4 Claims, 3 Drawing Sheets

(51) Int. Cl.

| | |
|---|---|
| ***F01L 1/245*** | (2006.01) |
| ***F01L 1/14*** | (2006.01) |
| ***F01L 1/16*** | (2006.01) |
| *F01L 1/18* | (2006.01) |
| *F01L 1/24* | (2006.01) |
| *F01L 1/047* | (2006.01) |
| *F01L 1/053* | (2006.01) |

(52) U.S. Cl.
CPC ..... *F01L 1/245* (2013.01); *F01L 1/185* (2013.01); *F01L 1/2405* (2013.01); *F01L 2001/0476* (2013.01); *F01L 2001/0537* (2013.01); *F01L 2105/00* (2013.01); *F01L 2107/00* (2013.01); *F02F 1/242* (2013.01); *F02F 2001/245* (2013.01)

(58) Field of Classification Search
USPC ..... 123/193.5, 193.3, 90.5
See application file for complete search history.

(56) References Cited

U.S. PATENT DOCUMENTS 4,709,667 A * 12/1987 Ichihara ..... F01L 1/053 123/90.27
5,012,783 A * 5/1991 Ferrazzi ..... F01L 1/265 123/432
5,031,586 A * 7/1991 Masuda ..... F01L 1/2405 123/196 M
5,125,374 A * 6/1992 Saito ..... F01L 1/265 123/432
RE35,382 E * 11/1996 Saito ..... F01L 1/053 123/90.27
5,603,301 A * 2/1997 Sakurai ..... F02D 41/0002 123/308
5,662,078 A * 9/1997 Adegawa ..... F01L 3/04 123/188.3
5,996,541 A * 12/1999 Voigt ..... F01L 1/053 123/193.5
6,125,806 A * 10/2000 Nishi ..... F01L 1/024 123/90.27
6,276,334 B1 * 8/2001 Flynn ..... F02B 19/14 123/435
6,684,859 B2 * 2/2004 Bredesen ..... F02M 57/023 123/470
6,796,281 B2 * 9/2004 Shimoyama ..... F01L 1/053 123/188.2
6,863,038 B2 * 3/2005 Yamauchi ..... F01L 1/022 123/90.16
7,114,473 B2 * 10/2006 Taki ..... F01L 1/022 123/90.15
7,464,677 B2 * 12/2008 Neal ..... F01L 13/0036 123/90.16
7,665,435 B2 * 2/2010 Imazato ..... F01L 1/053 123/193.5
7,891,329 B2 * 2/2011 Neal ..... F01L 13/0036 123/90.16
8,201,538 B2 * 6/2012 Imazato ..... F01L 1/053 123/196 M
8,281,766 B2 * 10/2012 Tomiita ..... F02M 35/10177 123/432
8,567,362 B2 * 10/2013 Hiramatsu ..... F01L 1/053 123/90.33
8,820,277 B2 * 9/2014 Moon ..... F01L 1/2405 123/90.15
2003/0094155 A1 * 5/2003 Shimoyama ..... F01L 1/053 123/188.2
2003/0192510 A1 * 10/2003 Bredesen ..... F02M 61/168 123/470
2004/0139935 A1 * 7/2004 Yamauchi ..... F01L 1/022 123/90.15
2005/0022766 A1 * 2/2005 Taki ..... F01L 1/022 123/90.18
2007/0261652 A1 * 11/2007 Neal ..... F01L 13/0036 123/90.48
2009/0229560 A1 * 9/2009 Woodcroft ..... F01L 3/08 123/193.6
2011/0036314 A1 * 2/2011 Yasui ..... F01L 1/185 123/90.5
2012/0323467 A1 * 12/2012 Okoshi ..... F02D 41/182 701/104
2015/0240671 A1 * 8/2015 Nakamura ..... F02D 13/0211 123/90.16

FOREIGN PATENT DOCUMENTS

| | | | |
|---|---|---|---|
| FR | 2 929 657 | A3 | 10/2009 |
| JP | 2006-46139 | A | 2/2006 |
| JP | 2008-115746 | A | 5/2008 |
| JP | 2008-286057 | A | 11/2008 |
| JP | 2008-291714 | A | 12/2008 |
| JP | 2009-85056 | A | 4/2009 |
| JP | 2010-121475 | A | 6/2010 |
| JP | 2010-249060 | A | 11/2010 |

OTHER PUBLICATIONS

Japanese Office Action dated Jun. 14, 2016, issued by the Japanese Patent Office in the corresponding application JP 2013-002550.
German Office Action dated Nov. 21, 2016, issued by the German Patent Office in corresponding application DE 10 2015 000 390.6.
Notification of Reasons for Refusal dated Dec. 2, 2016, issued by the Japanese Office Action in corresponding application JP 2013-002550.

* cited by examiner

CYLINDER HEAD OF ENGINE

CROSS-REFERENCE TO RELATED APPLICATIONS

This application claims the benefit of Japanese Application No. 2013-002550, filed Jan. 10, 2013, in the Japanese Patent Office. All disclosures of the document(s) named above are incorporated herein by reference.

BACKGROUND OF THE INVENTION

1. Field of the Invention

The invention relates to a cylinder head of an engine, and more particularly, to a cylinder head of an engine capable of preventing cylindrical parts for lash adjustors holding lash adjustors from being inclined due to a force applied upon opening/closing of intake valves.

2. Description of the Related Art

As shown in FIG. 6, an engine 101 includes a combustion chamber 103 disposed in a cylinder head 102, two intake ports 104 communicating with the combustion chamber 103, two intake valves 106 configured to open and close intake openings 105 of the two intake ports 104, two swing arms 108 rotatably supported by lash adjustors 107, respectively, and configured to drive the intake valves 106, respectively and two fuel injection valves 110 attached to an intake manifold 109 and configured to inject fuel into the two intake ports 104, respectively.

Patent Document 1 discloses a cylinder head of an engine provided with two intake ports communicating with a combustion chamber of the cylinder head, two intake valves configured to open and close intake openings of the intake ports, respectively, and two swing arms supported to lash adjustors and configured to drive the intake valves. Also, Patent Document 2 discloses a cylinder head of an engine provided with fuel injection valves configured to respectively inject fuel into two intake ports communicating with a combustion chamber of the cylinder head.

The cylinder head of an engine disclosed in Patent Document 1 has a structure in which the fuel injection valves are respectively provided at the two intake ports communicating with the combustion chamber and the lash adjustors respectively support the two swing arms. Cylindrical parts for the fuel injection valves, into which the fuel injection valves are inserted are provided along an outer wall of a cam housing. Thereby, it is not necessary to provide recess parts in cylindrical parts for the lash adjustors, into which the lash adjustors disposed in the cam housing are inserted, for avoiding interference with the fuel injection valves, so that rigidity of the cylindrical parts for the lash adjustors are secured.

Patent Document 1: Japanese Patent Application Publication No. 2010-249060A

Patent Document 2: Japanese Patent Application Publication No. 2009-085056A

As shown in FIG. 6, in the cylinder head 102 of the engine 101, cylindrical parts 111 for the lash adjustor into which the lash adjustors 107 are inserted are disposed at positions spaced from a bottom surface 114 of a bottom wall 113 partitioning a valve chamber 112 of the cylinder head 102. When the cylindrical parts 111 for the lash adjustors are connected to a sidewall 115 disposed at an intake-side of the cylinder head 102, a space 117 may be formed between a lower end portion 116 of the cylindrical parts 111 for the lash adjustors and the bottom surface 114 of the valve chamber 112.

In the cylinder head 102 of the engine 101 having the above structure, the cylindrical parts 111 for the lash adjustors are deformed and inclined by a force applied from intake cams at the time of opening/closing of the intake valves 106. Thereby, there is a problem that the sidewall 115 of the cylinder head 102 vibrates to thus generate noise. Also, as the cylindrical parts 111 for the lash adjustors are inclined, there is a problem that a frictional force acting on a contact part between each of the lash adjustors 107 and each of the swing arms 108 increases to lower durability of the lash adjustors 107 or swing arms 108.

SUMMARY OF THE INVENTION

It is therefore an object of the present invention to prevent cylindrical parts for lash adjustors into which lash adjustors are inserted from being inclined at the time of opening/closing of intake valves, to solve a problem that a sidewall of a cylinder head vibrates to generate noise and to suppress a frictional force acting on a contact part between each of the lash adjustors and each of swing arms from increasing to solve a problem that the durability of the lash adjustors or swing arms is lowered.

In order to achieve the above object, according to an aspect of the embodiments of the present invention, there is provided a cylinder head of an engine, the engine including: a combustion chamber disposed in the cylinder head; two intake ports communicating with the combustion chamber; two intake valves configured to open and close intake openings of the two intake ports; two swing arms rotatably supported by lash adjustors, respectively, and configured to drive the intake valves, respectively; and two fuel injection valves attached to the cylinder head and configured to inject fuel into the two intake ports, respectively. The cylinder head comprises cylindrical parts for lash adjustors into which the lash adjustors are inserted and cylindrical parts for fuel injection valves into which the fuel injection valves are inserted. An outer periphery of each of the cylindrical parts for the lash adjustors is connected to a sidewall of the cylinder head, which is disposed above the intake ports and each of the cylindrical parts for the fuel injection valves is disposed below the cylindrical parts for the lash adjustors. A lower end portion of each of the cylindrical parts for the lash adjustors is connected to an upper part of the cylindrical parts for the fuel injection valves by a reinforcement part.

With this configuration, since the lower end portion of each of the cylindrical parts for the lash adjustors is connected to each of the cylindrical parts for the fuel injection valves by the reinforcement part, it is possible to rigidly connect the cylindrical parts for the lash adjustors to the cylindrical parts for the fuel injection valves, each of which has a cylindrical shape and is not easily deformed. Thereby, it is possible to prevent the cylindrical parts for the lash adjustors from being inclined due to a force applied at the time of opening/closing of the intake valves. Therefore, it is possible to prevent the sidewall of the cylinder head from vibrating to generate noise.

Also, as the cylindrical parts for the lash adjustors are prevented from being inclined, it is possible to reduce a frictional force acting on contact parts between the lash adjustors and the swing arms, thereby improving the durability of the lash adjustors or swing arms.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
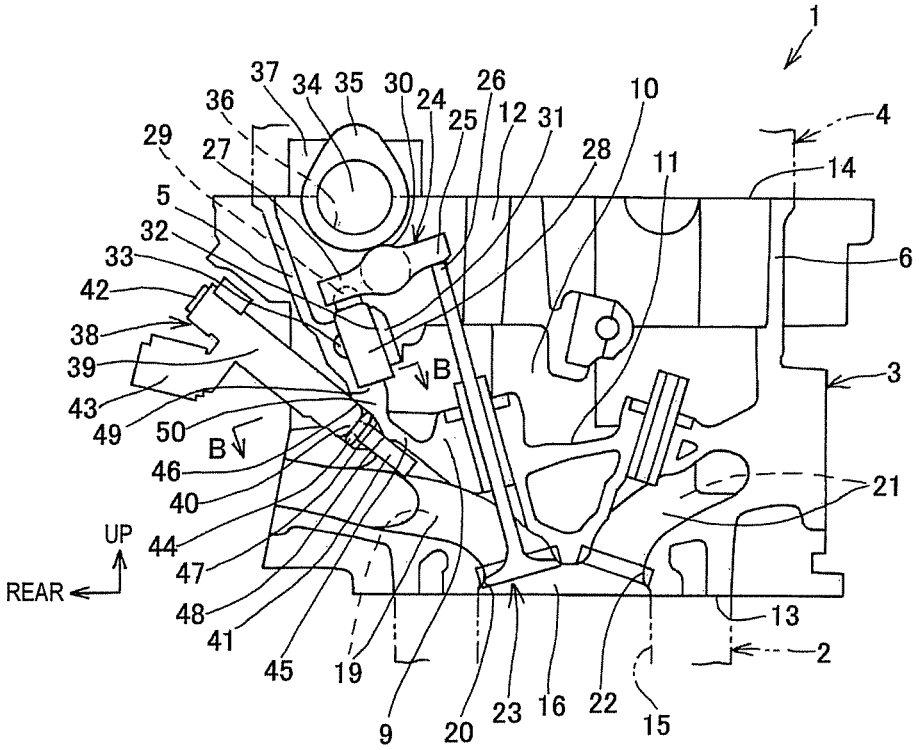
FIG. 1 is a sectional view of a cylinder head of an engine taken along a line A-A in FIG. 4 (according to an illustrative embodiment)
Figure 2:
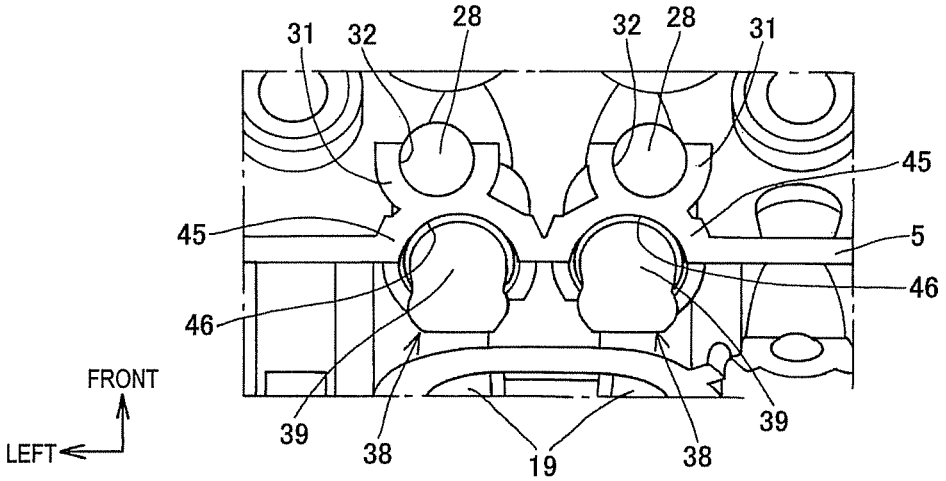
FIG. 2 is a sectional view of the cylinder head taken along a line B-B in FIG. 1 (according to the illustrative embodiment)

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
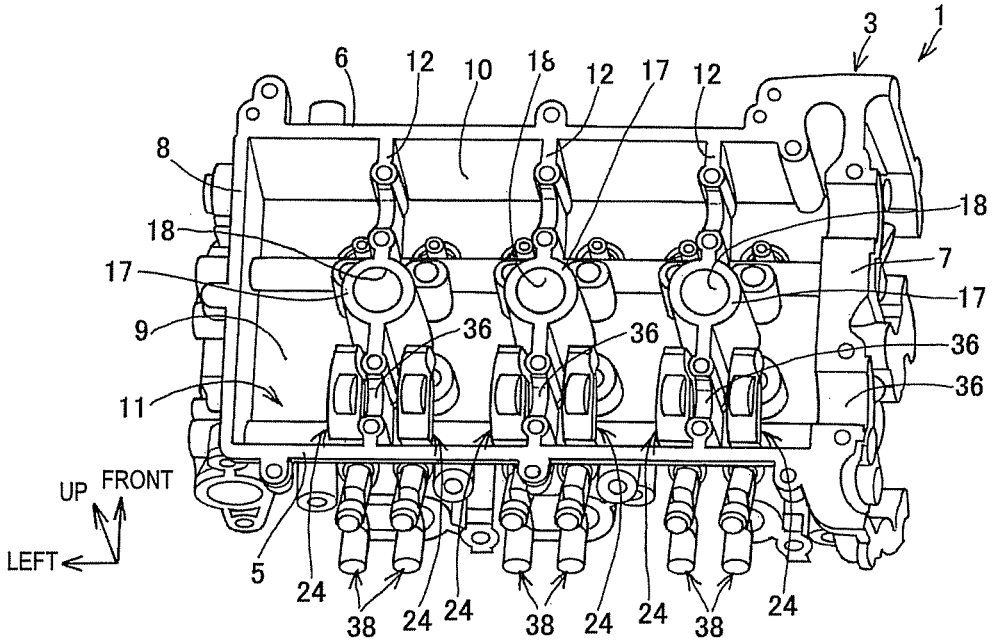
FIG. 3 is a perspective view of the cylinder head (according to the illustrative embodiment)
Figure 4:
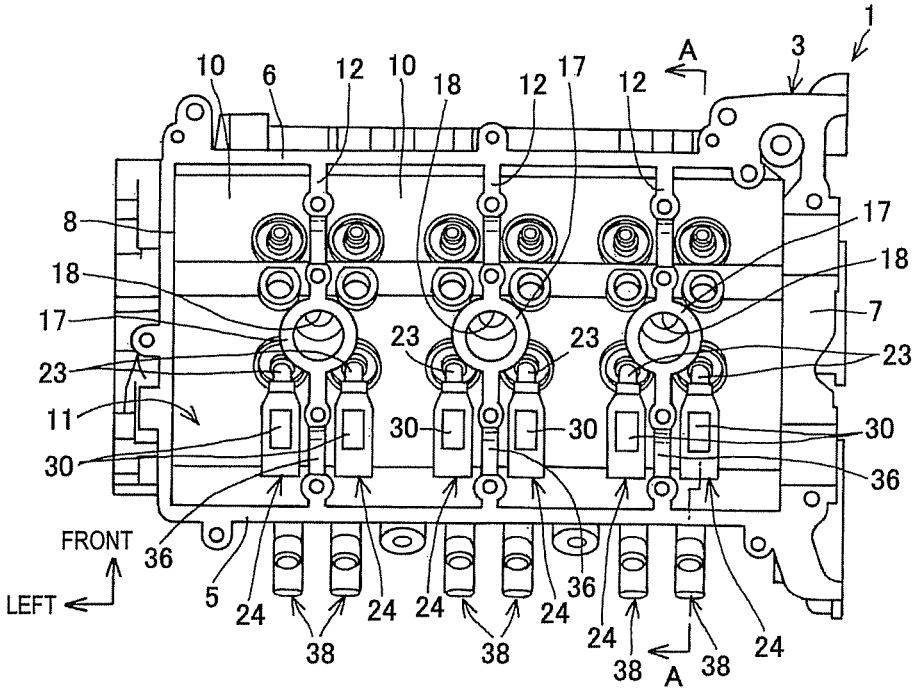
FIG. 4 is a plan view of the cylinder head (according to the illustrative embodiment)
Figure 5:
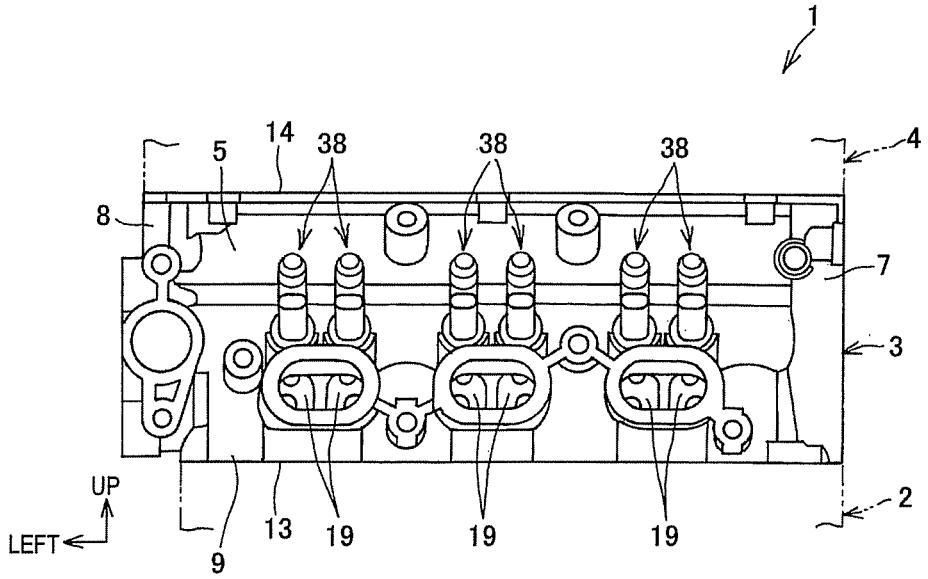
FIG. 5 is a side view of the cylinder head (according to the illustrative embodiment)
Figure 6:
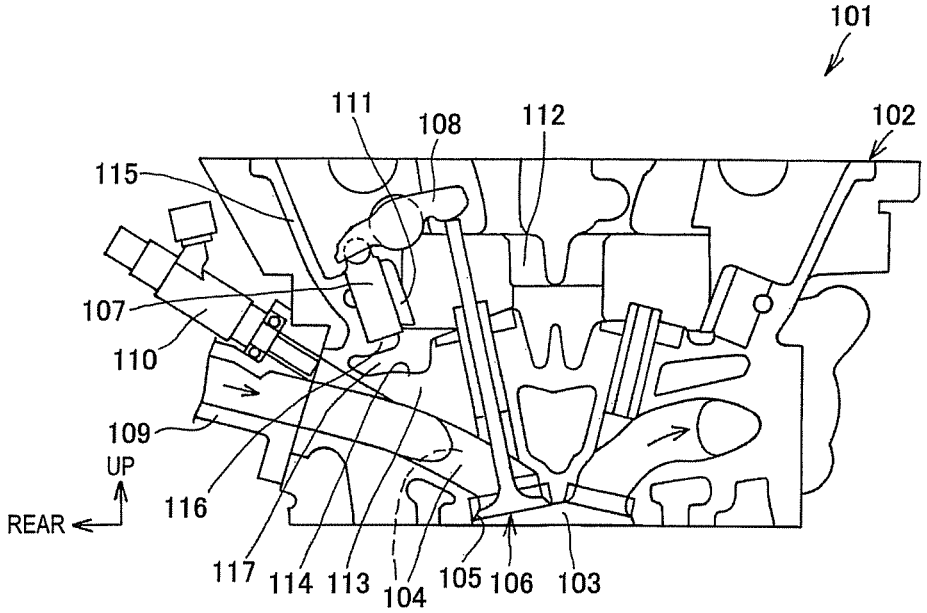
FIG. 6 is a sectional view of a cylinder head of an engine (according to the related art).

FIGS. 1 to 5 show the illustrative embodiment of the present invention. As shown in FIGS. 1 and 5, an engine 1 has a cylinder block 2, a cylinder head 3 attached to an upper part of the cylinder block 2, a cylinder head cover 4 attached to an upper part of the cylinder head 3 and a crankshaft pivotally supported at a lower part of the cylinder block 2.

As shown in FIGS. 3 and 4, the cylinder head 3 is formed into a substantially rectangular box shape, which is longer in a longitudinal direction than in a width direction when seen in a plan view. The box shape is comprised of one set of sidewalls 5, 6 arranged to face each other in the width direction, one set of end walls 7, 8 arranged to face each other in the longitudinal direction and connected to end portions of the one set of sidewalls 5, 6 and a bottom wall 9 connecting lower parts of the respective sidewalls 5, 6 and the respective end walls 7, 8. A valve chamber 10 is formed in the cylinder head 3. A plurality of connection walls 12 connecting the one set of sidewalls 5, 6 are formed on a bottom surface 11 of the bottom wall 9 of the valve chamber 10. As shown in FIGS. 1 and 5, the cylinder head 3 is provided with a cylinder block joint surface 13 at the lower parts of the one set of sidewalls 5, 6 and the one set of the end walls 7, 8 and a head cover joint surface 14 at upper parts of the one set of sidewalls 5, 6, the one set of end walls 7, 8 and the connection walls 12.

The engine 1 is attached with a chain cover (not shown) at one end-side of the cylinder block 2 and the cylinder head in the longitudinal direction to form a chain chamber and is attached with a transmission (not shown) at another end-side of the cylinder block 2 in the longitudinal direction. Thus, the end wall 7 of the cylinder head 3 at one end-side in the longitudinal direction is a chain chamber-side end wall 7 and the end wall 8 of the cylinder head 3 at another end-side in the longitudinal direction is a transmission-side end wall 8.

As shown in FIG. 1, in the cylinder head 3 of the engine 1, a combustion chamber 16 having a shape coinciding with a cylinder 15 of the cylinder block 5 is disposed below the bottom part 9. The connection wall 12 is disposed so as to pass above the combustion chamber 16 and to extend in the width direction of the cylinder head 3. As shown in FIGS. 3 and 4, the connection wall 12 is formed with a peripheral wall 18 for an ignition plug forming an ignition plug hole 17 connecting to the combustion chamber 16.

The cylinder head 3 is formed with two intake ports 19 communicating with the combustion chamber 16. The two intake ports 19 are joined together at upstream side thereof so as to open to the sidewall 5 of one side in the width direction, penetrate the bottom wall 9 at middle portion thereof and are diverged from one another at downstream side thereof so as to communicate with intake openings 20 of the combustion chamber 16, respectively. Thereby, the sidewall 5 of the cylinder head 3 at one side in the width direction is referred to as a intake-side sidewall 5. Also, the cylinder head 3 is formed with two exhaust ports 21 communicating with the combustion chamber 16. The two exhaust ports 21 are diverged from one another at upstream side thereof so as to communicate with exhaust openings 22, 22 of the combustion chamber 16, respectively, penetrate the bottom wall 9 at middle portion thereof and are joined together at downstream side thereof so as to open to the sidewall 6 of another side in the width direction. Thereby, the sidewall 6 of the cylinder head 3 at another side in the width direction is referred to as an exhaust-side sidewall 6.

As shown in FIG. 1, the cylinder head 3 is provided with intake valves 23 configured to open and close the intake openings 20 of the two intake ports 19 communicating with the combustion chamber 16, respectively. As shown in FIG. 4, the respective intake valves 23 are disposed at both sides of the connection wall 12 which connects the intake-side sidewall 5 and the exhaust-side sidewall 6 of the valve chamber 10, so as to sandwich the connection wall 12 therebetween. The respective intake valves 23 are operated so as to open and close by intake-side swing arms 24, respectively. Each intake-side swing arm 24 has an abutting part 25 at one end-side, which abuts to a leading end portion 26 of the intake valve 23, an engaging part 27 at another end-side, which is rotatably supported by a support part 29 of a intake-side lash adjustor 28, and a roller 30 at a middle portion thereof.

The cylinder head 3 is provided with cylindrical parts 31 for the intake-side lash adjustors, into which the intake-side lash adjustors 28 are inserted. Each of the cylindrical parts 31 for the intake-side lash adjustors is connected to an outer peripheral surface to the intake-side sidewall 5 disposed above the intake ports 19 and holds each of the intake-side lash adjustors 28 inserted into insertion holes 32 for intake-side lash adjustors. The intake-side lash adjustor 28 extends the support part 29 by an oil pressure supplied from an oil passage 33 for a lash adjustor to thereby press the engaging part 27 of the intake-side swing arm 24. By the pressing force, the intake-side lash adjustor 28 presses the roller 30 to an intake-side cam 35 of an intake-side camshaft 34.

The intake-side camshaft 34 is pivotally supported by intake-side lower cam housings 36 (refer to FIGS. 3 and 4) which are formed at positions of the chain chamber-side end wall 7 and the connecting walls 12 close to the intake-side sidewall 5 and by intake-side cam caps 37. The intake-side camshaft 34 is rotated in synchronization with the crankshaft by a timing chain to swing the intake-side swing arms 24 by the intake-side cams 35, thereby opening and closing the intake valves 23.

The cylinder head 3 is provided with exhaust valves (not shown) configured to open and close the exhaust openings 22 of the two exhaust ports 21. Each exhaust valve is opened and closed in the same configuration as the intake valve 23. That is, the two exhaust valves are respectively operated so as to open and close by exhaust-side swing arms. Each exhaust-side swing arm is provided with one end-side which abuts to the exhaust valve, another end-side which is rotatably supported by an exhaust-side lash adjustor, and a roller at a middle portion thereof. Each exhaust-side lash adjustor presses the exhaust-side swing arm by an oil pressure and by this pressing force, presses the roller toward an exhaust-side cam of an exhaust-side camshaft so as to abut the roller to the exhaust-side cam. The exhaust-side camshaft is rotated in synchronization with the crankshaft by the timing chain and swings the exhaust-side lash adjustors by the exhaust-side cams, thereby opening and closing the exhaust valves.

The cylinder head 3 of the engine 1 is attached with two fuel injection valves 38 configured to inject fuel into the two intake ports 19, respectively. The two fuel injection valves 38 are disposed at both sides of the connection wall 12 so as to sandwich the connection wall 12 therebetween. Each fuel injection valve 38 is provided with a shaft-shaped main body part 39, a small-diameter injection part 41 provided at a leading end of the main body part 39 with a step-shaped abutting part 40 being interposed, a fuel entrance part 42 disposed at a rear end of the main body part 39 and a wiring connector part 43 protruding from a vicinity of the rear end of the main body part 39. Each fuel injection valve 38 is mounted with a circular seal ring 44. The circular seal ring 44 is arranged at outer periphery of a base end of the injection part 41 so that the circular seal ring 44 abuts to the abutting part 40.

The cylinder head 3 is provided with cylindrical parts 45 for the fuel injection valves, into which the two fuel injection valves 38 are inserted, respectively. Each of the cylindrical parts 45 for the fuel injection valves is provided with an insertion hole 46 for the fuel injection valve and a small-diameter communication hole 48 for the fuel injection valve, continuing to the insertion hole 46 for the fuel injection valve via a step-shaped diameter-reduced part 47 and communicating with the intake port 19.

The fuel injection valves 38 are attached to the cylindrical parts 45 for the fuel injection valves in a state where the main body parts 39 are inserted into the insertion holes 46 for the fuel injection valves of the cylindrical parts 45 for the fuel injection valves with the seal rings 44 mounted on the base ends of the injection parts 41 being slightly compressed by the insertion holes 46 for the fuel injection valves and the injection parts 41 at the leading ends are inserted into the connection holes 48 for the fuel injection valves so as to face the intake ports 19. The seal rings 44 inserted into the insertion hole 46 for the fuel injection valve while being compressed are disposed below the cylindrical parts 31 for the intake-side lash adjustors in the longitudinal direction of the cylindrical parts 45 for the fuel injection valves to seal gaps between the main body parts 39 of the fuel injection valves 38 and the insertion holes 46 for the fuel injection valves of the cylindrical parts 45 for the fuel injection valves.

In the cylinder head 3 of the engine 1, the outer periphery of each of the cylindrical parts 31 for the intake-side lash adjustors is connected to the intake-side sidewall 5 disposed above the intake ports 19, the cylindrical parts 45 for the fuel injection valves are disposed below the cylindrical parts 31 for the intake-side lash adjustors and a lower end portion 49 of each of the cylindrical parts 31 for the intake-side lash adjustors is connected to an upper part of each of the cylindrical parts 45 for the fuel injection valves by a reinforcement part 50.

Like this, since the cylinder head 3 of the engine 1 connects the lower end portion 49 of each of the cylindrical parts 31 for the intake-side lash adjustors to the cylindrical parts 45 for the fuel injection valves by the reinforcement part 50, it is possible to rigidly connect the cylindrical parts 31 for the intake-side lash adjustors to the cylindrical parts 45 for the fuel injection valves, each of which has a cylindrical shape and is not easily deformed. Thereby, it is possible to prevent the cylindrical parts 31 for the intake-side lash adjustors from being inclined due to the force applied at the time of opening/closing of the intake valves 23. Therefore, it is possible to prevent the intake-side sidewall 5 of the cylinder head 3 from vibrating to generate the noise. As the inclination is prevented, it is possible to reduce frictional force acting on contact parts between the engaging parts 27 of the intake-side swing arms 24 and the support parts 29 of the intake-side lash adjustors 28, thereby improving the durability of the intake-side swing arms 24 or intake-side lash adjustors 28.

The cylinder head 3 of the engine 1 is provided with the circular seal ring 44, which seals each of the gaps between the fuel injection valves 38 and the cylindrical parts 45 for the fuel injection valves, at the outer periphery of the injection part 41 of each of the fuel injection valves 38. A part of each of the cylindrical parts 45 for the fuel injection valves, at which the seal ring 44 is disposed in the longitudinal direction, is disposed below the cylindrical parts 31 for the intake-side lash adjustors.

An inner diameter of each of the insertion holes 46 for the fuel injection valves at positions where the seal rings 44 are disposed in the longitudinal direction of the cylindrical parts 45 for the fuel injection valves are larger than an inner diameter of the communication holes 48 for the fuel injection valves at a side of the leading ends relative to the positions where the seal rings 44 are disposed.

Therefore, in the cylinder head 3 of the engine 1, the part of each of the cylindrical parts 45 for the fuel injection valves, at which the seal ring 44 is disposed is disposed below each of the cylindrical parts 31 for the intake-side lash adjustors in the longitudinal direction thereof, so that a distance from each of the cylindrical parts 45 for the fuel injection valves to the lower end portion 49 of each of the cylindrical parts 31 for the intake-side lash adjustors can be shortened and both can be thus connected more rigidly. Also, as the distance is shortened, it is possible to reduce a volume of the reinforcement part 50 and to lighten the cylinder head 3.

The present invention can prevent the sidewall of the cylinder head, to which the cylindrical parts for the lash adjustors are connected, from vibrating to generate the noise and solve the problem that the durability of the lash adjustors or swing arms is lowered and can be applied to a cylinder head of an engine, that opens and closes valves through lash adjustors or swing arms by a camshaft.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A cylinder head of an engine, the engine comprising:

a combustion chamber disposed in the cylinder head;

first and second intake ports communicating with the combustion chamber;

first and second intake valves configured to open and close intake openings of the first and second intake ports;

first and second swing arms rotatably supported by first and second lash adjustors and configured to drive the first and second intake valves, respectively; and first and second fuel injection valves attached to the cylinder head and configured to inject fuel into the first and second intake ports, respectively, wherein the cylinder head comprises:

a first cylindrical part into which the first lash adjustor is inserted:

a second cylindrical part into which the second lash adjustor is inserted;

a third cylindrical part into which the first fuel injection valve is inserted; and a fourth cylindrical part into which the second fuel injection valve is inserted, wherein an inner side surface of a sidewall of the cylinder head, which is extended upward from the first and second intake ports, is connected to a part of an outer periphery of the first cylindrical part for the first lash adjustor and a part of an outer periphery of the second cylindrical part for the second lash adjustor such that the inner side surface of the sidewall of the cylinder head is connected to serve as the parts of the outer peripheries of the first and second cylindrical parts for the first and second lash adjustors, wherein a part of the third cylindrical part for the first fuel injection valve is formed to serve as a bottom part of the first cylindrical part for the first lash adjustor and a part of the fourth cylindrical part for the second fuel injection valve is formed to serve as a bottom part of the second cylindrical part for the second lash adjustor, wherein the third cylindrical part for the first fuel injection valve and the first cylindrical part for the first lash adjustor overlap at least partially with each other and the fourth cylindrical part for the second fuel injection valve and the second cylindrical part for the second lash adjustor overlap at least partially with each other, when seen in a direction coaxial to a central axis of a cylinder of the cylinder head, wherein the third cylindrical part for the first fuel injection valve and the fourth cylindrical part for the second fuel injection valve are arranged side by side and are connected directly to each other, wherein a distance between an axial center of the third cylindrical part and an axial center of the fourth cylindrical part is shorter than a distance between an axial center of the first cylindrical part and an axial center of the second cylindrical part, and wherein in a cross section obtained by cutting the cylinder head in a plane along lower ends of the first cylindrical part and the second cylindrical part, each of the first to fourth cylindrical parts is formed into a partial circle shape, wherein the partial circles located at the lower ends of the first cylindrical part and the second cylindrical part can be connected to the partial circles located at the the upper portions of the third cylindrical part and the fourth cylindrical part.

2. The cylinder head according to claim 1, wherein the first and second fuel injection valves are provided at outer peripheries thereof with circular seal rings that seal gaps between the first and second fuel injection valves and the third and fourth cylindrical parts for the first and second fuel injection valves; and parts of the third and fourth cylindrical parts for the first and second fuel injection valves, at which the seal rings are disposed in a longitudinal direction thereof, are disposed below the first and second cylindrical parts for the first and second lash adjustors in the longitudinal direction.

3. The cylinder head according to claim 1, wherein the first and second fuel injection valves are exposed at an outer side with respect to the sidewall of the cylinder head and the first and second lash adjustors are exposed at an inner side with respect to the sidewall of the cylinder head.

4. The cylinder head according to claim 1, wherein a part of the first cylindrical part, a part of the second cylindrical part, a part of the third cylindrical part, a part of the fourth cylindrical part constitute a part of the sidewall of the cylinder head.

* * * * *